United States Patent [19]

Wiley et al.

[11] Patent Number: 4,821,925

[45] Date of Patent: Apr. 18, 1989

[54] NARROW, MULTIFLAVOR BEVERAGE DISPENSER VALVE ASSEMBLY AND TOWER

[75] Inventors: Ronald L. Wiley, Marietta; Kathryn M. Chase, Atlanta; Annie T. Ellis, Smyrna; Roger C. Whigham, Atlanta, all of Ga.

[73] Assignee: The Coca-Cola Company, Atlanta, Ga.

[21] Appl. No.: 50,850

[22] Filed: May 14, 1987

[51] Int. Cl.[4] ..... B67D 5/56

[52] U.S. Cl. ..... 222/129.4; 222/144.5; 137/884; 137/606

[58] Field of Search ..... 222/129.1, 129, 129.4, 222/132, 144.5, 54, 14, 71; 239/434; 137/884, 606, 560, 574

[56] References Cited

U.S. PATENT DOCUMENTS

| | | | |
|---|---|---|---|
| 1,261,986 | 4/1918 | White | 137/606 |
| 1,600,170 | 9/1926 | Henderson | 222/129.1 |
| 3,009,653 | 11/1961 | Hedeman | 222/129.4 |
| 3,409,176 | 11/1968 | Krause | 222/70 |
| 3,664,550 | 5/1972 | Carothers | 222/129.2 |
| 3,698,432 | 10/1972 | Kutz | 137/884 |
| 3,735,898 | 5/1973 | Smith | 222/129.4 |
| 3,863,810 | 2/1975 | Hanson | 222/129.1 |
| 3,979,024 | 9/1976 | Hoppe | 222/67 |
| 4,162,028 | 7/1979 | Reichenberger | 222/129.4 |
| 4,174,872 | 11/1979 | Fessler | 312/290 |
| 4,440,030 | 4/1984 | Pounder et al. | 73/861.87 |
| 4,487,333 | 12/1984 | Pounder et al. | 222/54 |
| 4,619,378 | 10/1986 | De Man | 222/144.5 |

*Primary Examiner*—F. J. Bartuska
*Assistant Examiner*—Kenneth Noland
*Attorney, Agent, or Firm*—Thomas R. Boston; W. Dexter Brooks; Anthony L. Birch

[57] ABSTRACT

A multiflavor valve assembly and a multiflavor tower using such valve assembly. The valve assembly uses microprocessor controlled ratio control. The tower can dispense six flavors through a single nozzle assembly, while using significantly less counter space than six separate valves would require. The valve assembly uses two water flow modules, six syrup flow modules, one control board with a microprocessor, one interface board with its microprocessor, and thirteen touch buttons on the selection panel.

1 Claim, 24 Drawing Sheets

TYPICAL RATIO CONTROL
BLOCK DIAGRAM

TOWER CONTROL & BLOCK DIAGRAM

OVERALL PROGRAM SCHEME

PUSH BUTTON MONITOR

**Large select runs through TEST because P22 cannot be used as an output

CN13

| | |
|---|---|
| 1 wht/blk | 6 blk |
| 2 red/blk | 7 wht |
| 3 org/blk | 8 red |
| 4 grn/blk | 9 org |
| 5 blu/blk | 10 grn/wht |

NARROW, MULTIFLAVOR BEVERAGE DISPENSER VALVE ASSEMBLY AND TOWER

BACKGROUND OF THE INVENTION

1. Field of the Invention

This invention relates to beverage dispensers and in particular to a multiflavor valve assembly using microprocessor ratio control, and to a narrow dispensing tower using a single such multiflavor valve.

2. Description of the Prior Art

This invention employs certain features of a known ratio control system (described in U.S. Pat. No. 4,487,333), that controls the ratio of syrup to water using a syrup flow meter (such as is described in U.S. Pat. No. 4,440,030), a water flow meter, a syrup solenoid valve, a water solenoid vale, a microprocessor, and a personality module that tells the system what the ratio is supposed to be for the particular syrup to be used with that valve. Such known system will be referred to herein as a microprocessor ratio control system.

Using such known system to dispense six flavors, for example, it would be necessary to use six independent valves, which means six valve circuit control boards, six water flow meters, six syrup flow meters, six personality modules and 32 touch switches (or buttons on the selection panel).

It is an object of the present invention to provide a narrow, multiflavor dispensing valve and a narrow tower using one such valve.

It is another object of this invention to provide such a valve and tower using a known microprocessor ratio control system with the addition of an interface board with its own microprocessor.

It is a further object of this invention to provide an improved nozzle assembly for a multiflavor valve.

SUMMARY OF THE INVENTION

A multiflavor tower and a multiflavor valve assembly therefor, using a microprocessor ratio control system, that can dispense six flavors by using only one control circuit board, two water flow meters, six syrup flow meters, no personality modules, 13 touch switches or buttons, and an interface board with its own microprocessor. All six flavors are dispensed through a single valve assembly and its single nozzle assembly. The counter space required for the tower of this invention is signficantly less than that required for six separate valves. The interface board monitors the 13 push buttons. Once a flavor and a size (for example, small, medium, large or extra large) have been selected it:

1. connects the proper flow meters to the one valve control board, 2. provides information to the valve control board which would, in the prior art system, be provided by the personality module, 3. provides a signal to the valve control board to initiate a pour, 4. monitors the valve control board while the drink is being poured, 5. monitors a signal from the valve control board to determine if the flavor just dispensed has run out of syrup, and 6. remembers if a flavor has run out of syrup and if it has, prevents that flavor from being selected again.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENTS

Figure 1:
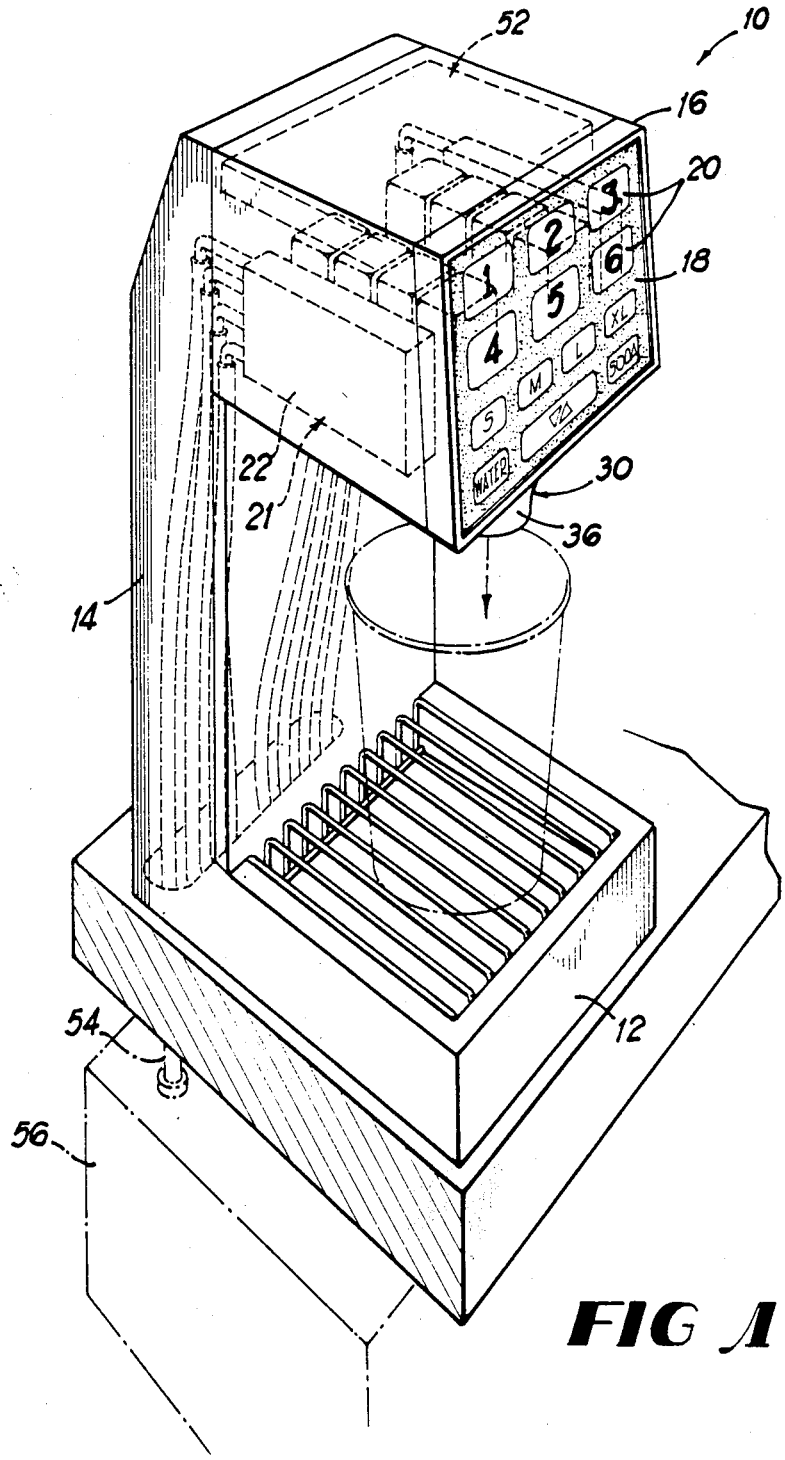
FIG. 1 is a front, left-side, top perspective view of the multiflavor tower of the present invention.
Figure 2:
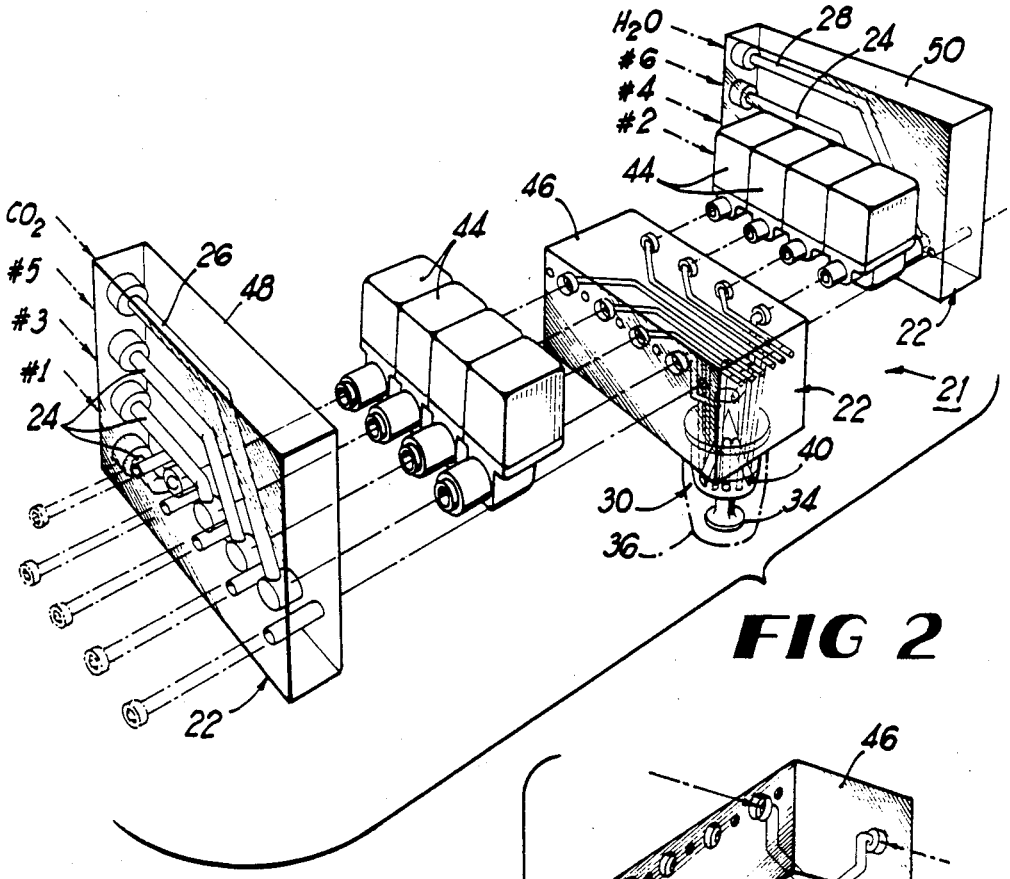
FIG. 2 is a perspective, exploded view of the flow modules and flow block of the tower.
Figure 3:
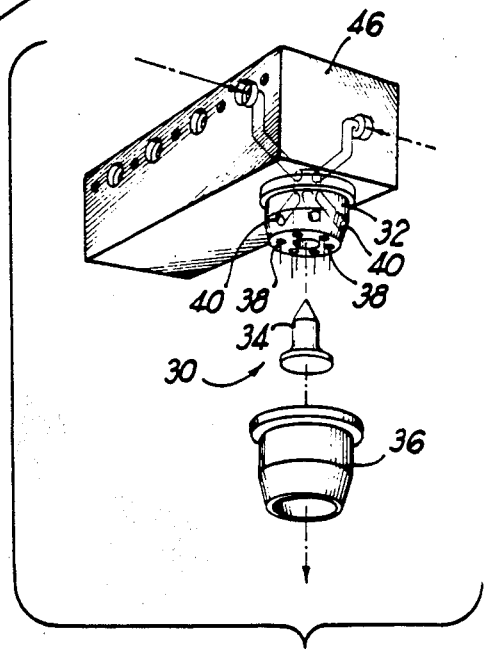
FIG. 3 is a perspective, exploded view of the valve block and nozzle assembly.
Figure 4:
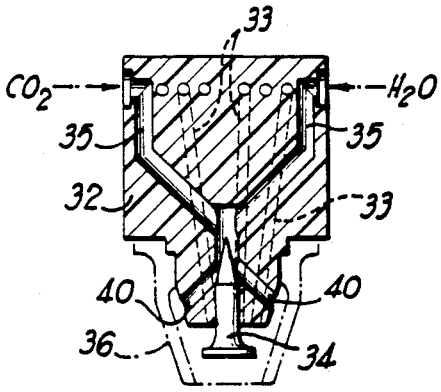
FIG. 4 is a cross-sectional view through the nozzle assembly.

With reference now to the drawings, FIG. 1 shows the multiflavor beverage dispensing tower 10 using the multiflavor valve assembly 21 of the present invention. The tower 10 includes a base 12, a back 14, and a head 16. The head includes a front panel 18 with 13 lighted buttons 20, including six different flavors, small, medium, large and extra larger portion control buttons, a water button, a soda button, and a Pour/Cancel button. The base 12 includes a grate and a drain as usual.

The head 16 includes therein the narrow multiflavor beverage dispenser valve assembly 21 of the present invention, including a flow block 22 and a single nozzle assembly 30. The flow block has six syrup conduits 24, a carbonated water conduit 26 and a still water conduit 28. All of the conduits have their distal ends connected to the single dispensing nozzle assembly 30. The nozzle assembly 30 includes a flow body 32, a target 34 and a spout 36. The body 32 has six syrup passageways 33 therethrough and six syrup openings 38, one for each of the six syrups, two water passageways 35 therethrough and a plurality of water openings 40. The target 34 is located below the syrup openings so that the syrup impinges thereon and mixes thoroughly with the water before being dispensed from the spout 30.

The flow block 22 also includes a flow control module 44 in each of the conduits for measuring and controlling the flow therethrough. The flow control modules 44 each include both a flow meter for measuring the flow rate and a solenoid operated flow control. The flow block 22 is preferably formed of three separate pieces including a central valve block 46 (to which is connected the nozzle assembly 30 in its bottom surface and four flow control modules 44 on each side) and a pair of manifolds 48 and 50, one connected to the four modules on each side of the valve block.

The head 16 also includes a solid state circuit board 52 that includes control means connected to each of the thirteen buttons on the panel 18 and to each of the flow meters and solenoids in each of the flow control modules.

A plurality of syrup and water tubes 54 extend up through the back 14 and connect to the respective conduits in the flow block 22. The tubes 54 and be connected to cooling coils in a refrigeration unit 56.

Figure 5:
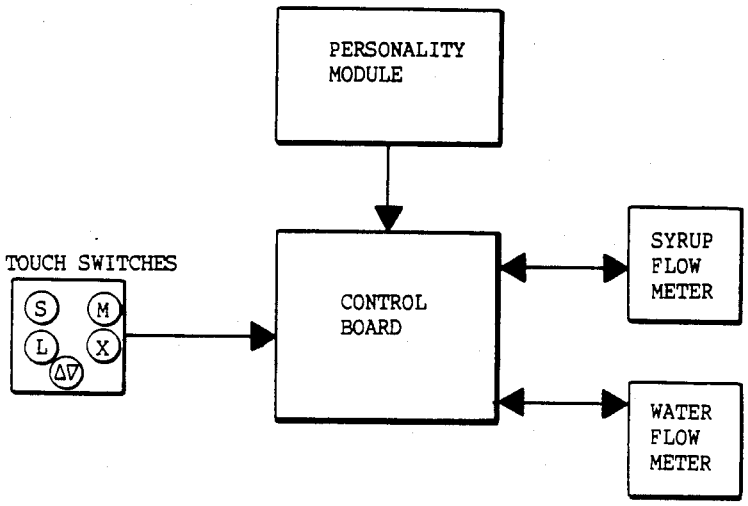
FIG. 5 is a block diagram of the known microprocessor ratio control system.

The control means will now be described with reference to FIGS. 5–20. FIG. 5 is a block diagram of a known ratio control system, wherein water and a single syrup is fed to and dispensed from a single valve assembly and the ratio is controlled by a single control system.

This system can switch from one syrup to another by changing from one personality module to another. The personality module tells the control board, for example, what the ratio should be for the particular beverage to be dispensed.

Figure 6:
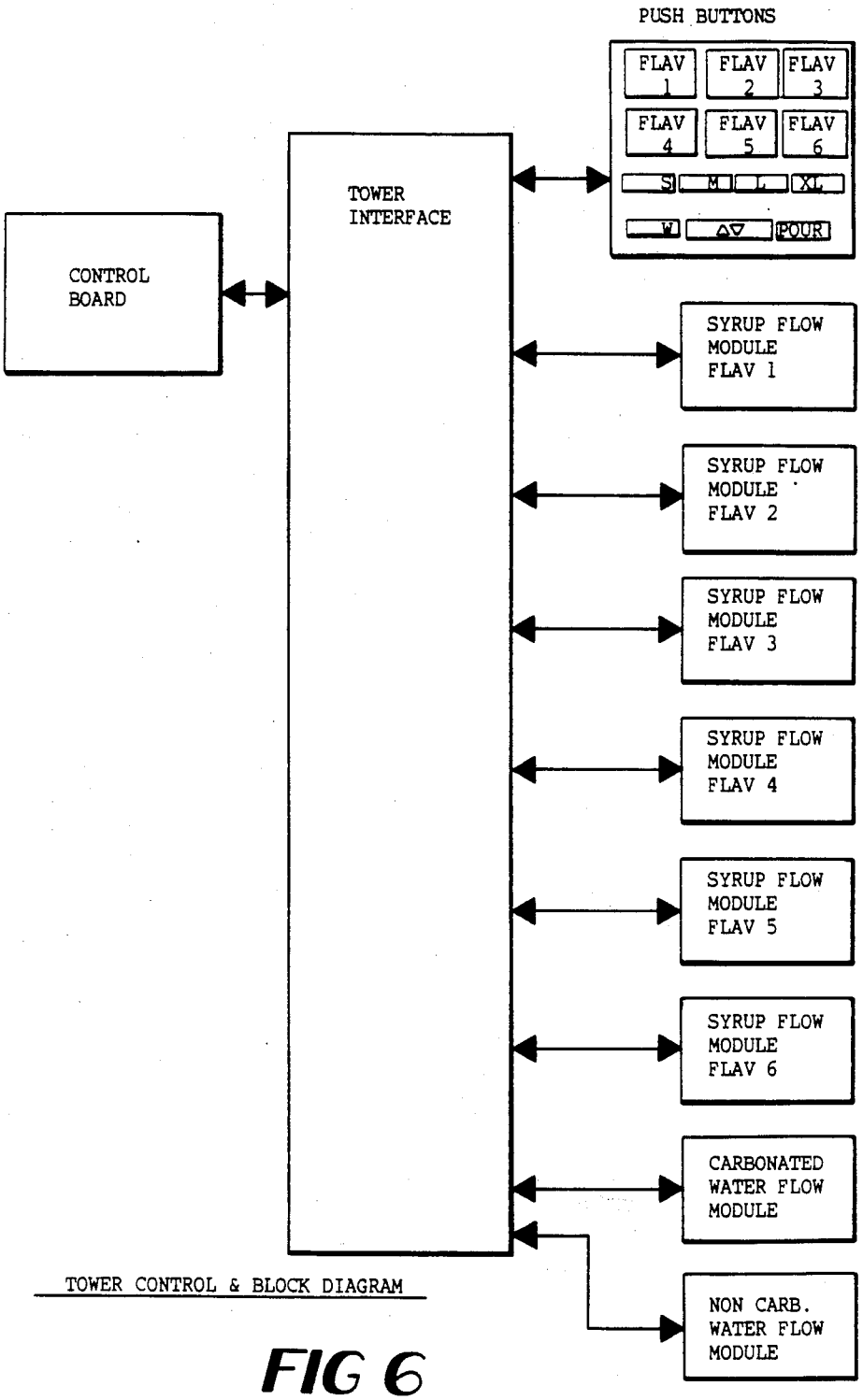
FIG. 6 is a block diagram of the control system of the present invention.

FIG. 6 is a block diagram of the control means in the present invention, which uses only one control board (with its microprocessor) for all six flavors, and that also uses an interface board (with its microprocessor).

Figure 7:
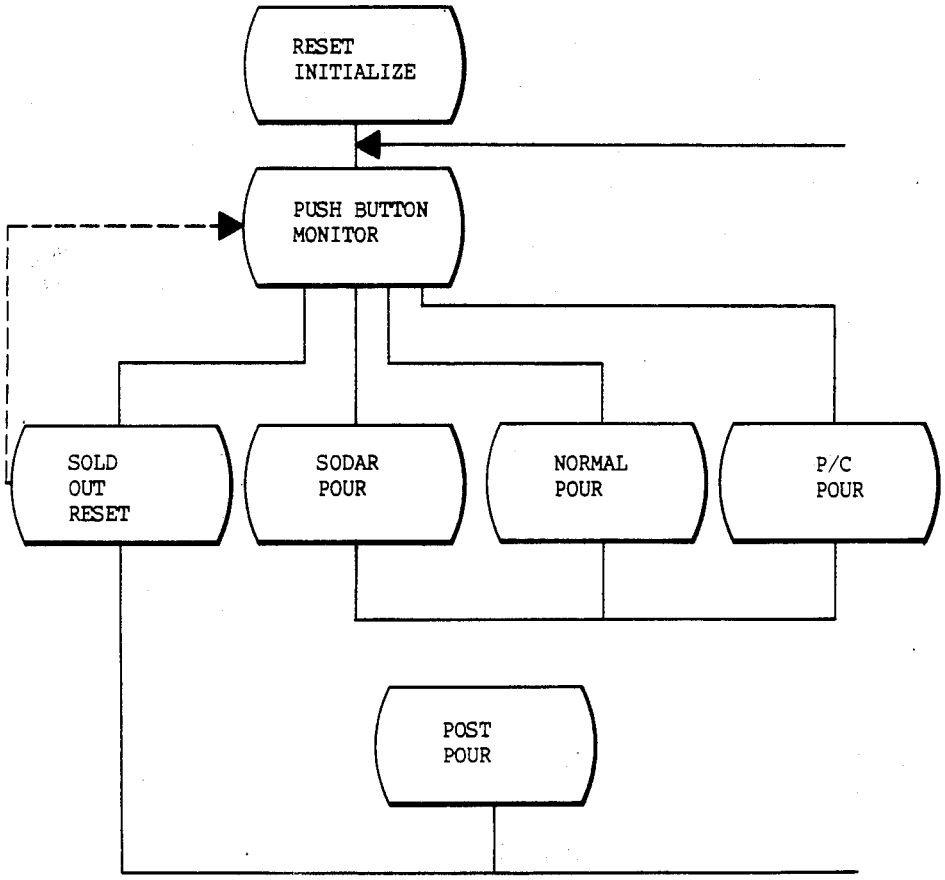
FIG. 7 is a block diagram of the overall program scheme of the present invention.
Figure 8:
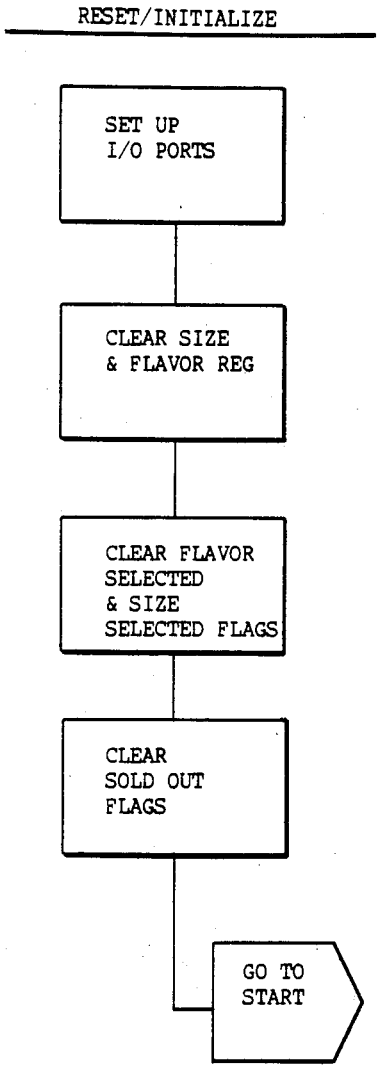
FIGS. 8–15 are a flow chart showing the program flow of the present invention; and FIGS. **16*a*–20*a* and 16*b*–20*b*** are electrical, schematic diagrams showing the circuits of the present invention.
Figure 9A:
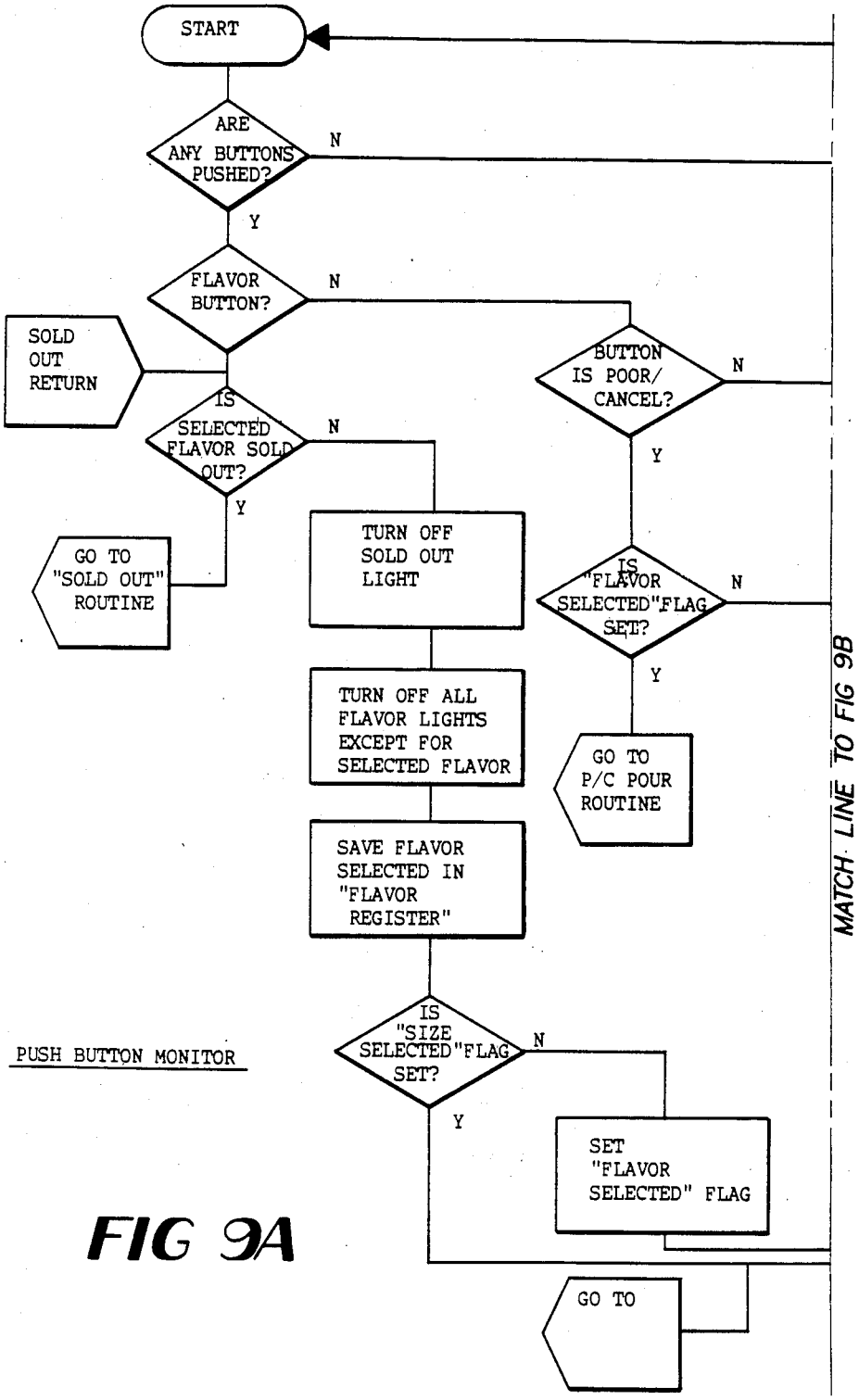
Figure 9B:
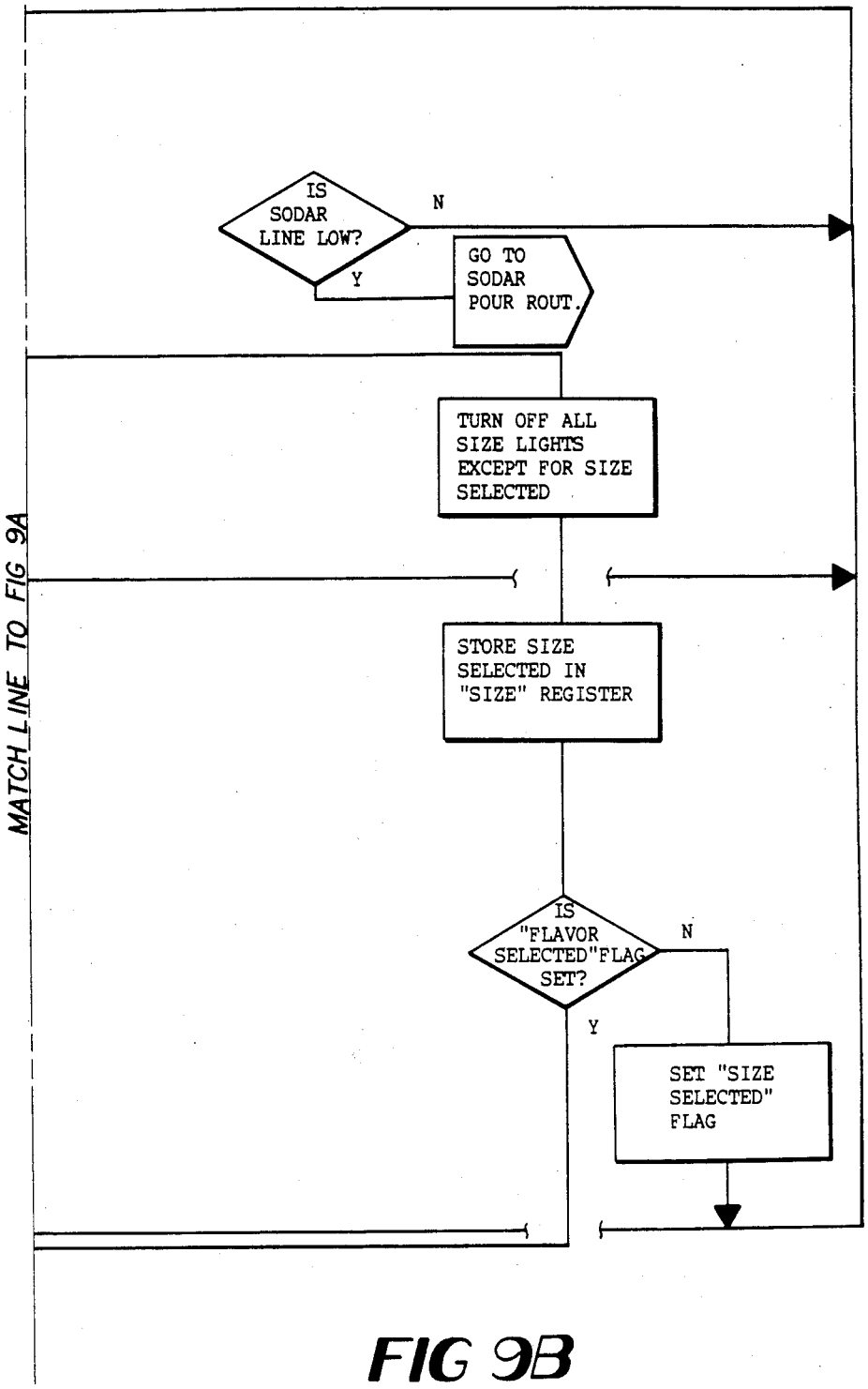
Figure 10:
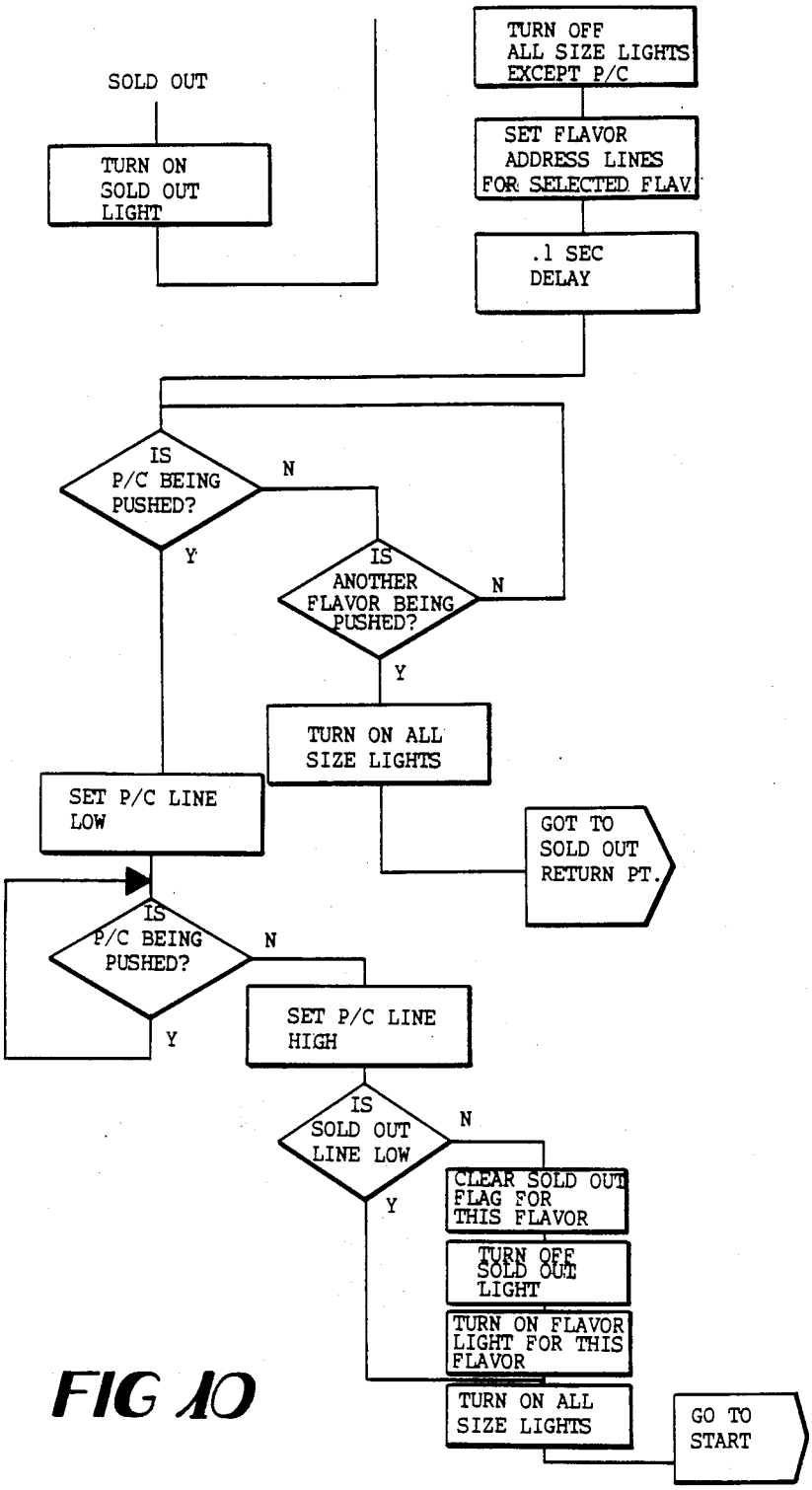
Figure 11:
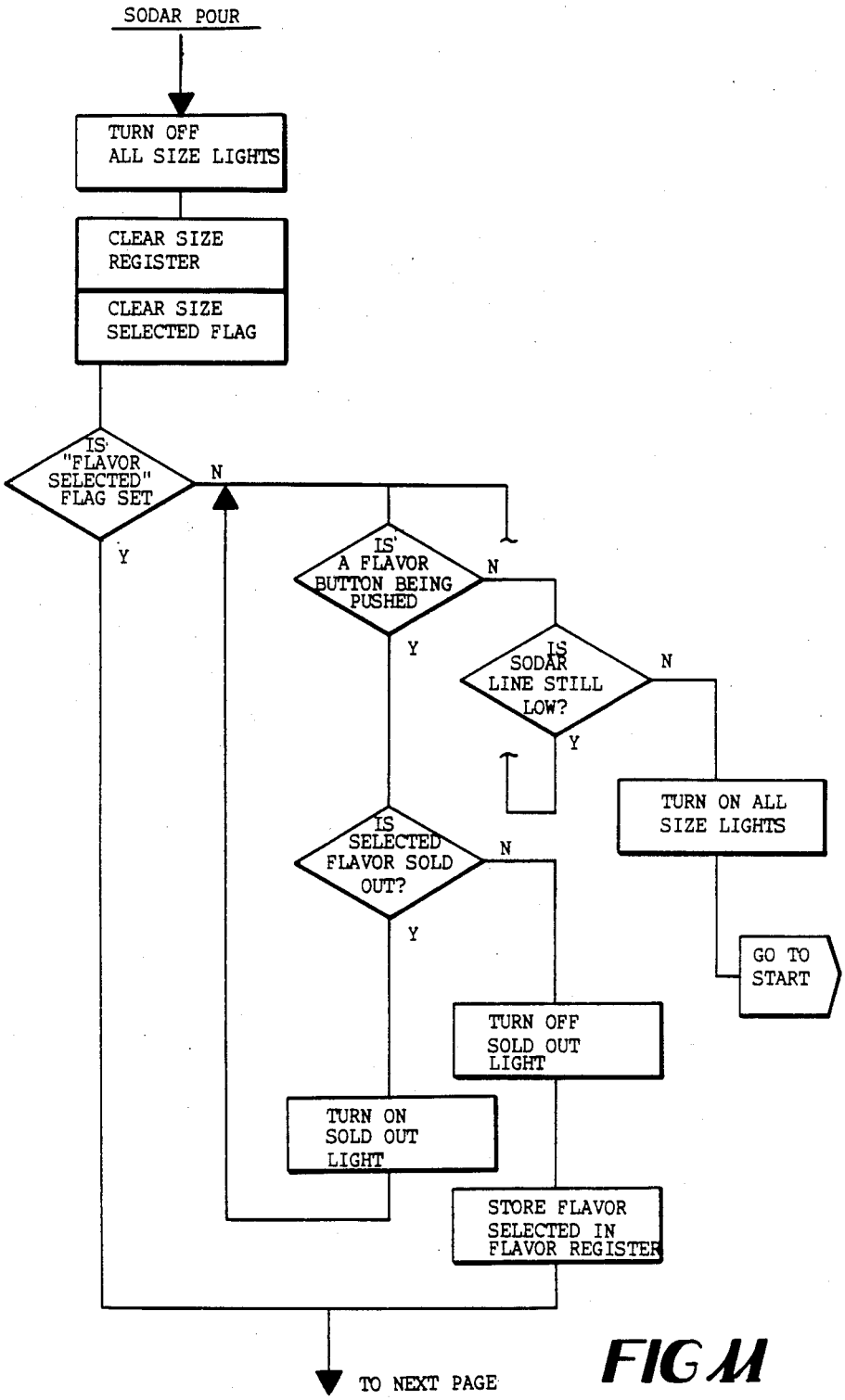
Figure 12:
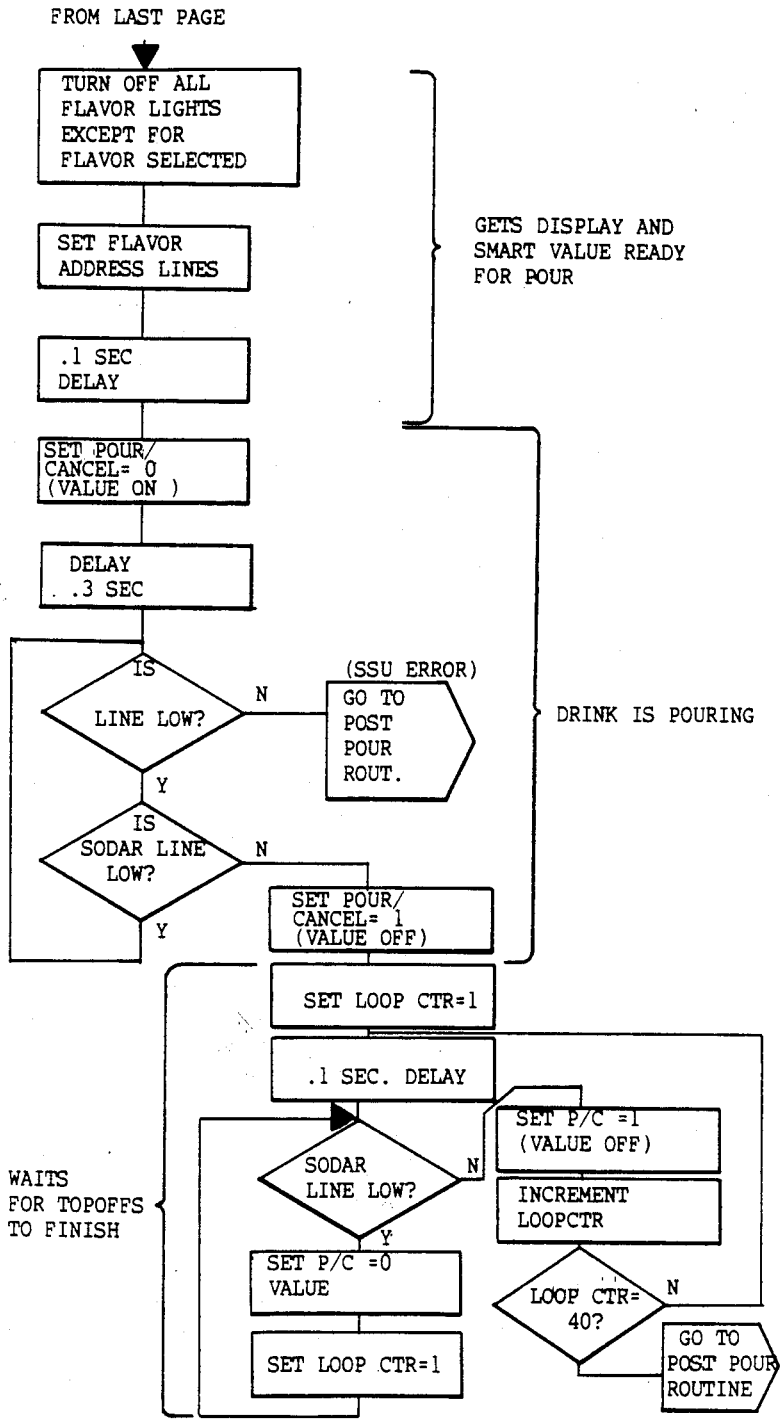
Figure 13:
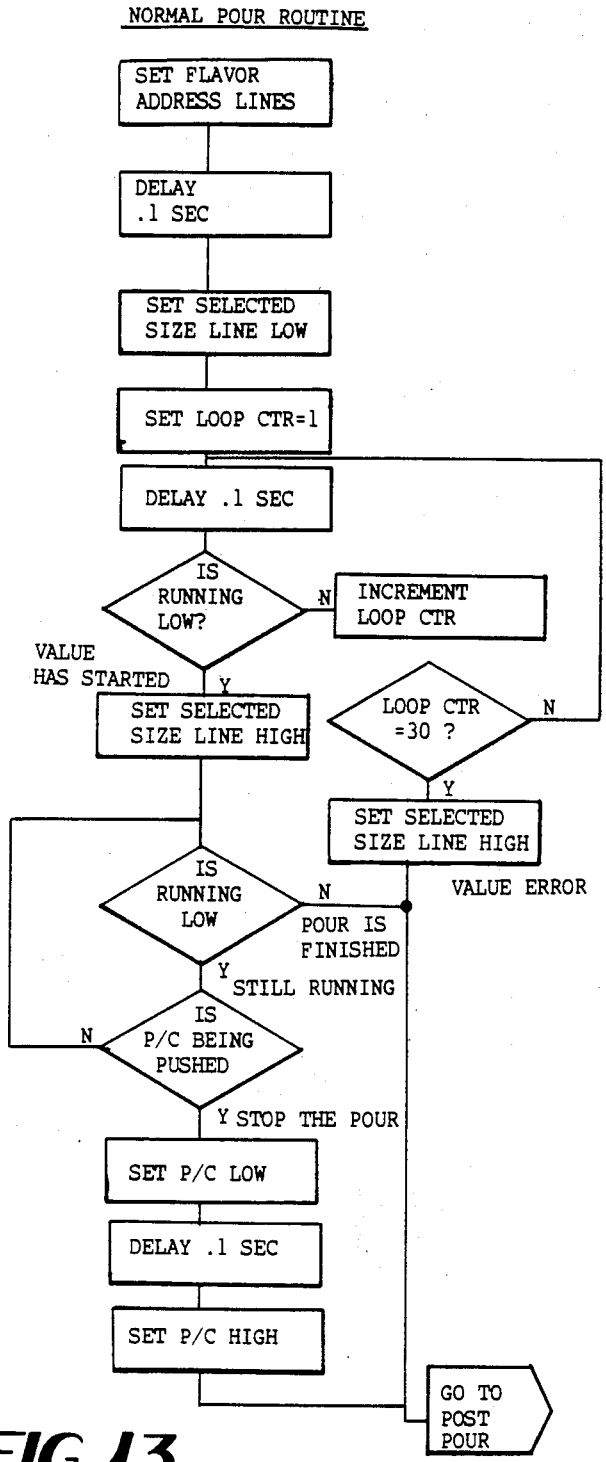
Figure 14:
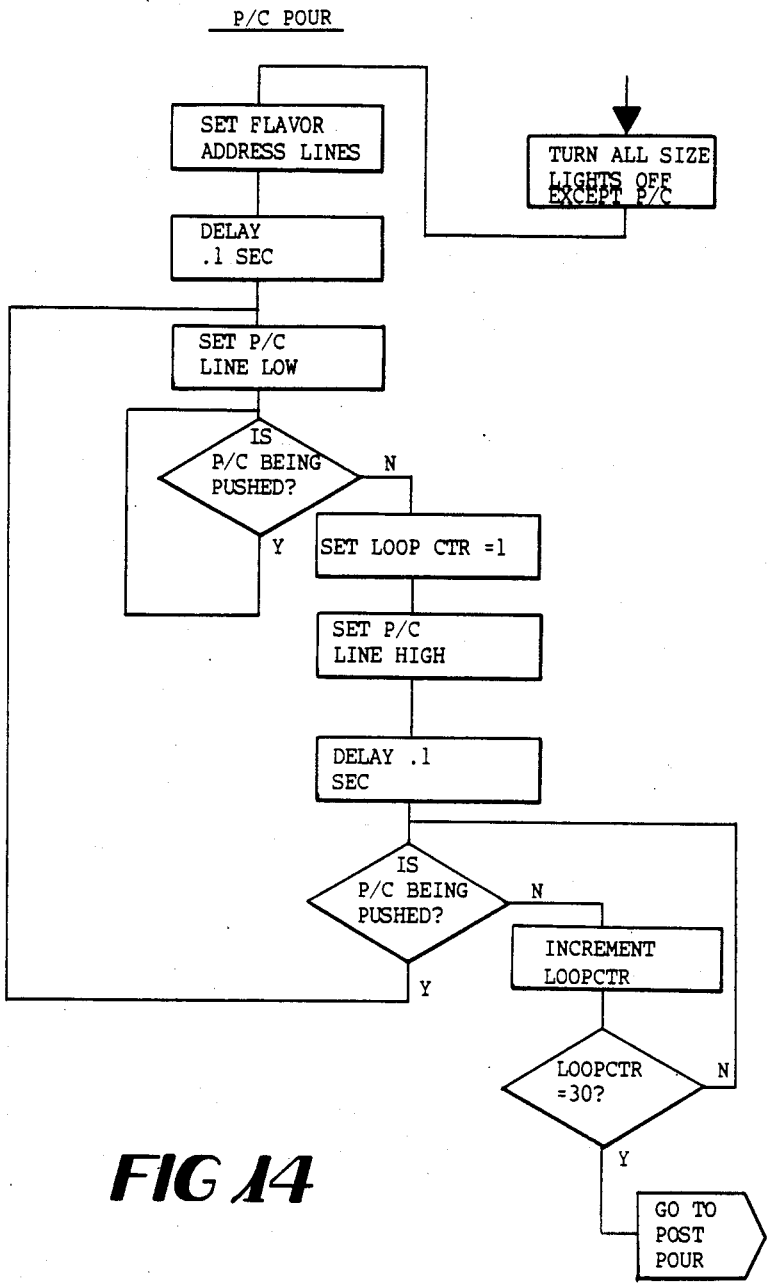
Figure 15:
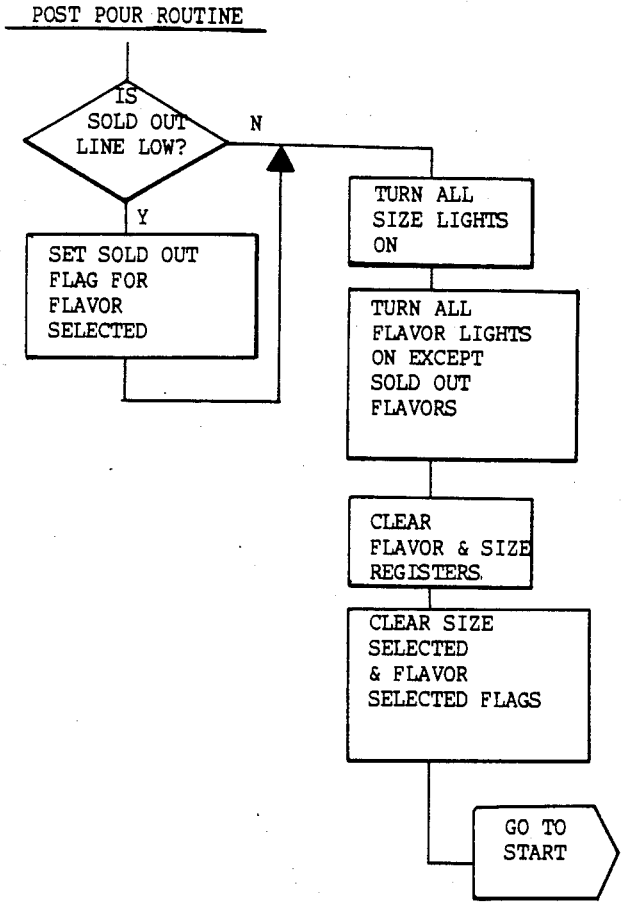
Figure 16A:
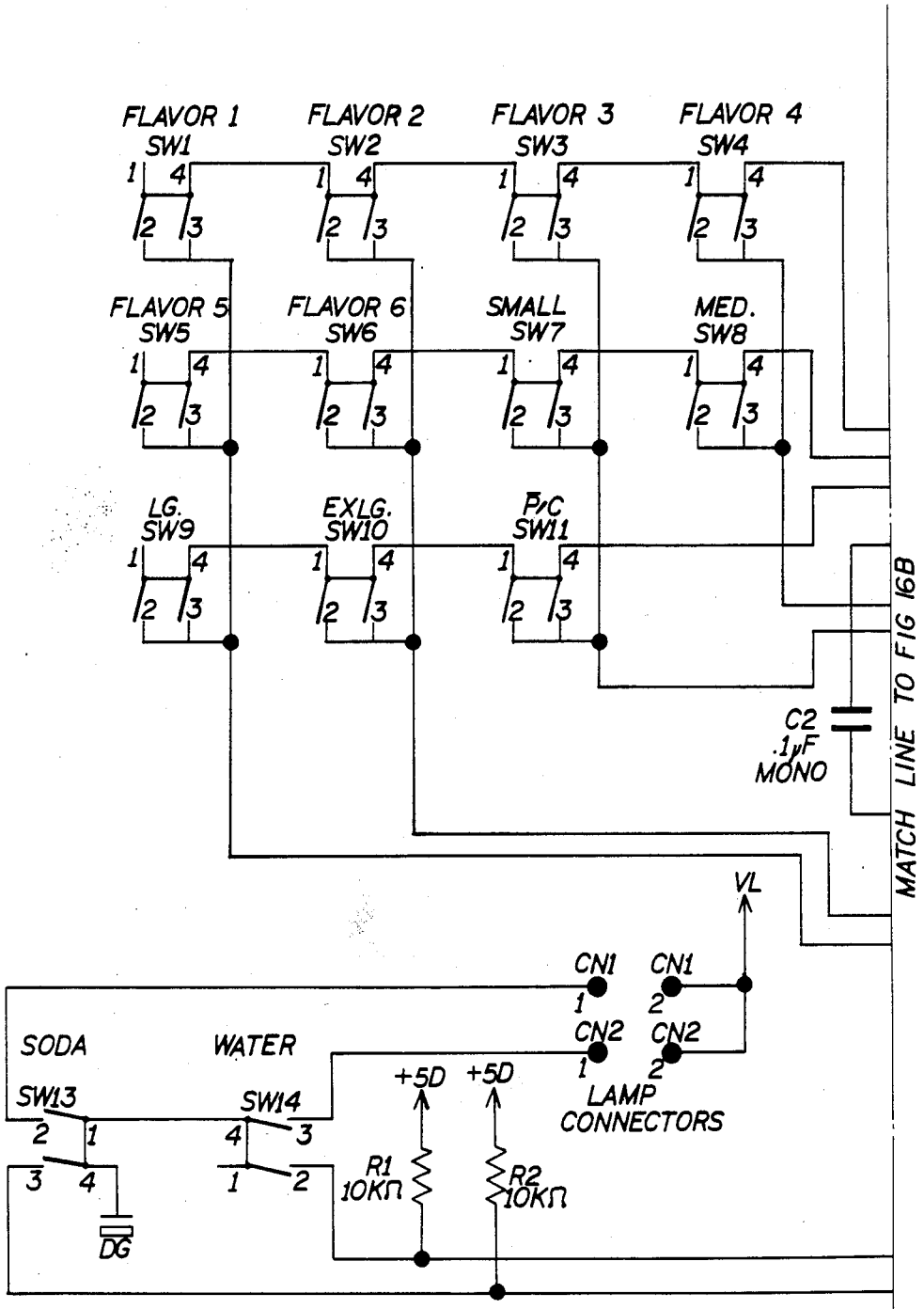
Figure 16B:
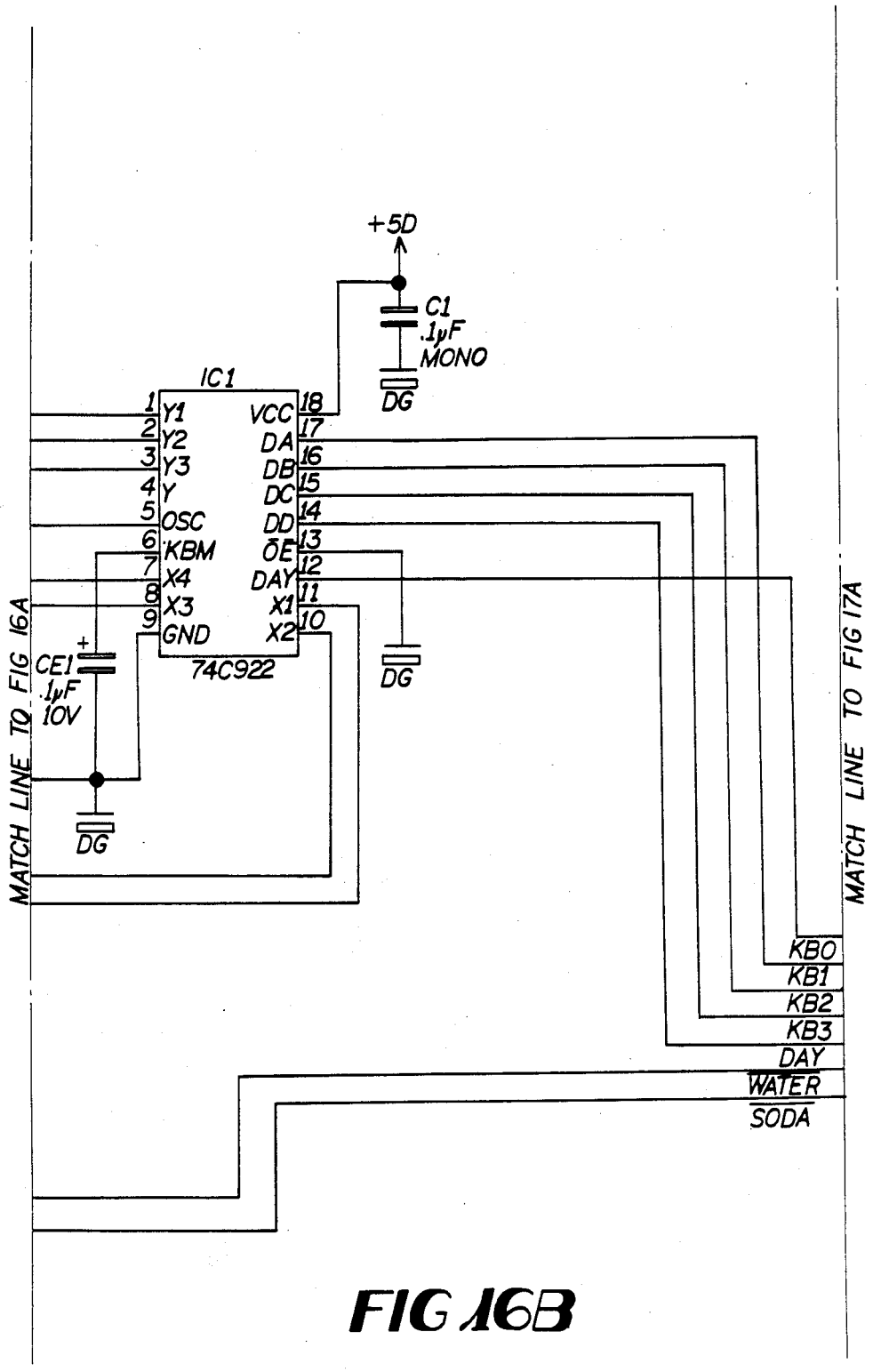
Figure 17A:
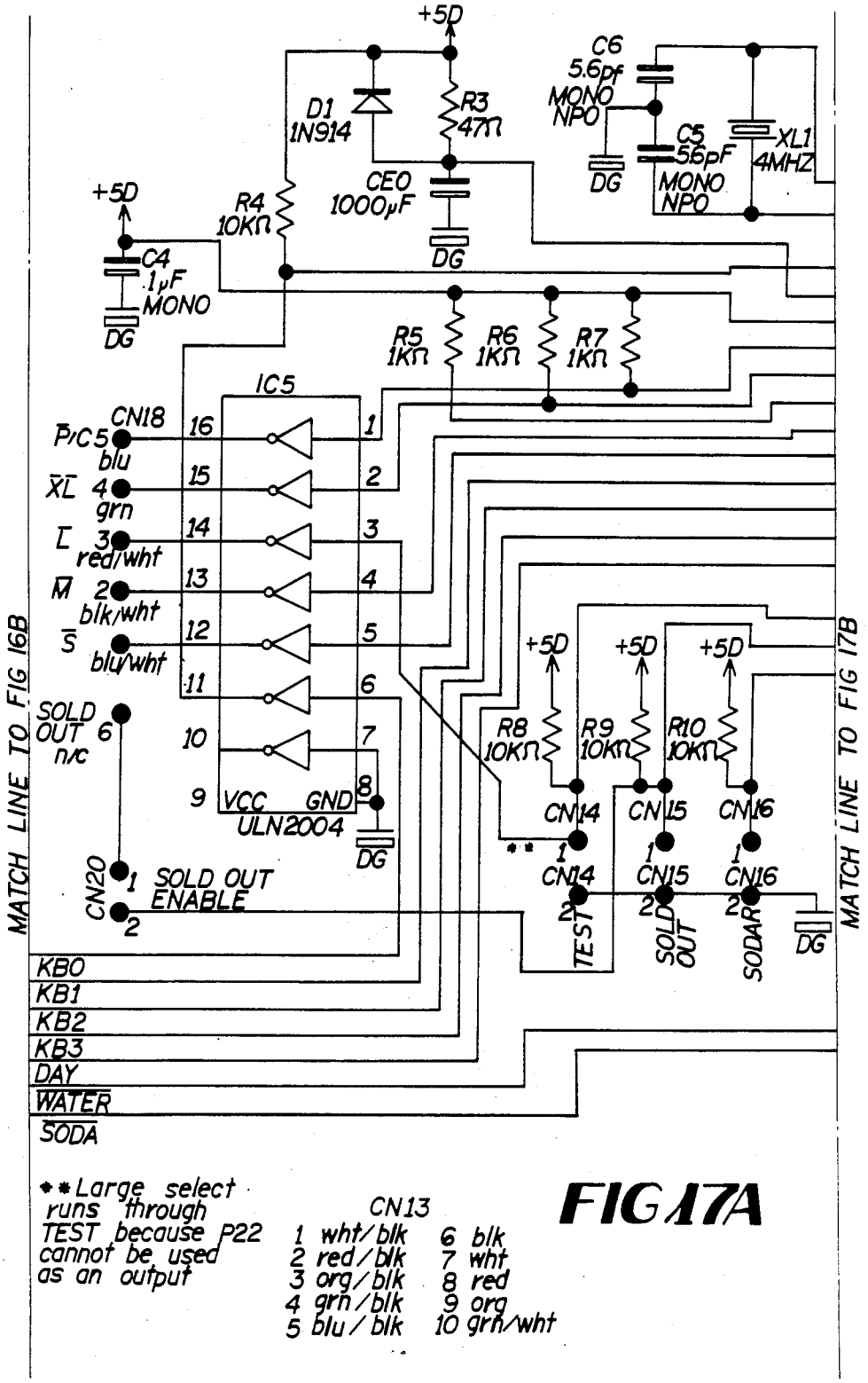
Figure 17B:
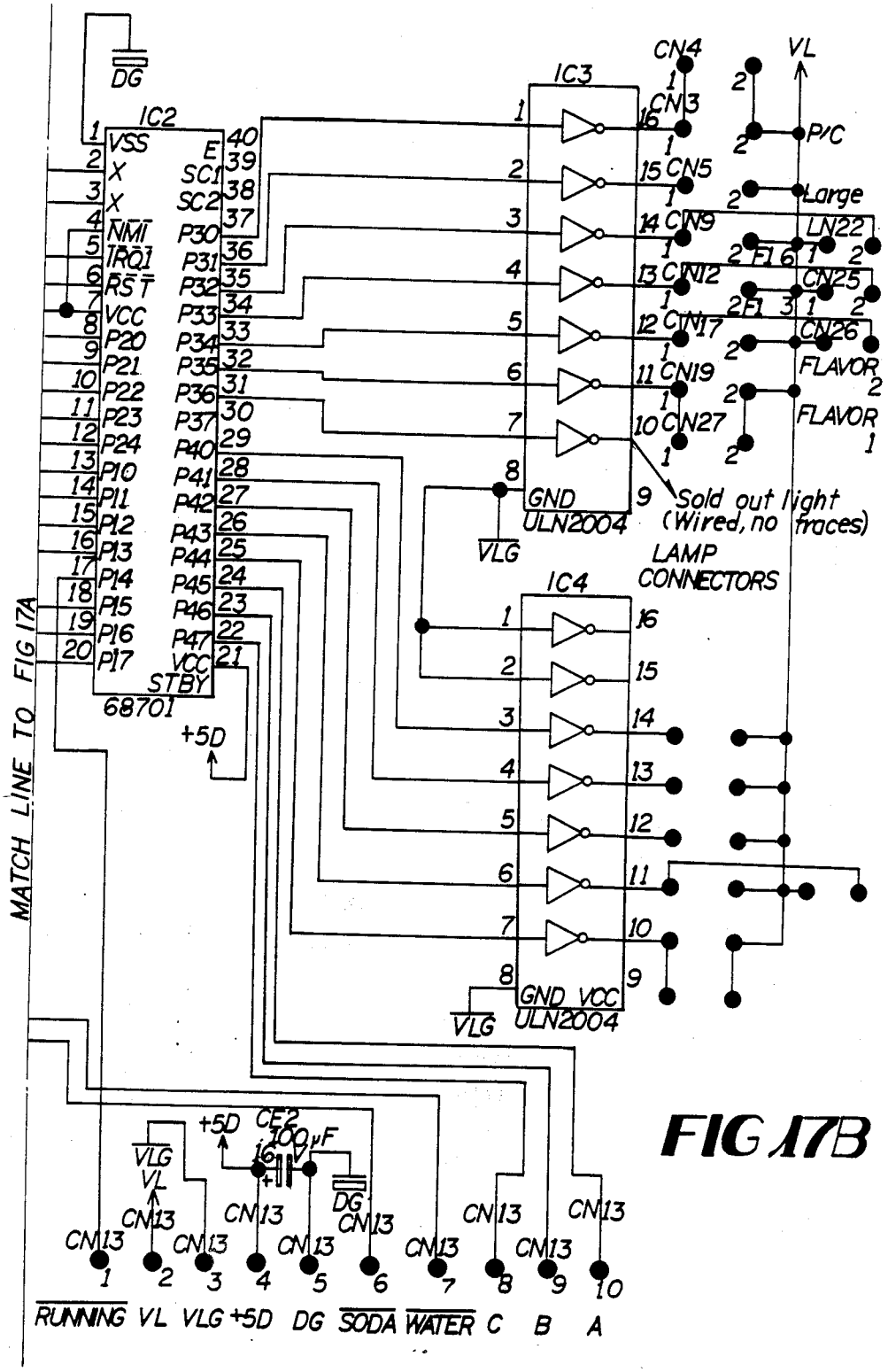
Figure 18A:
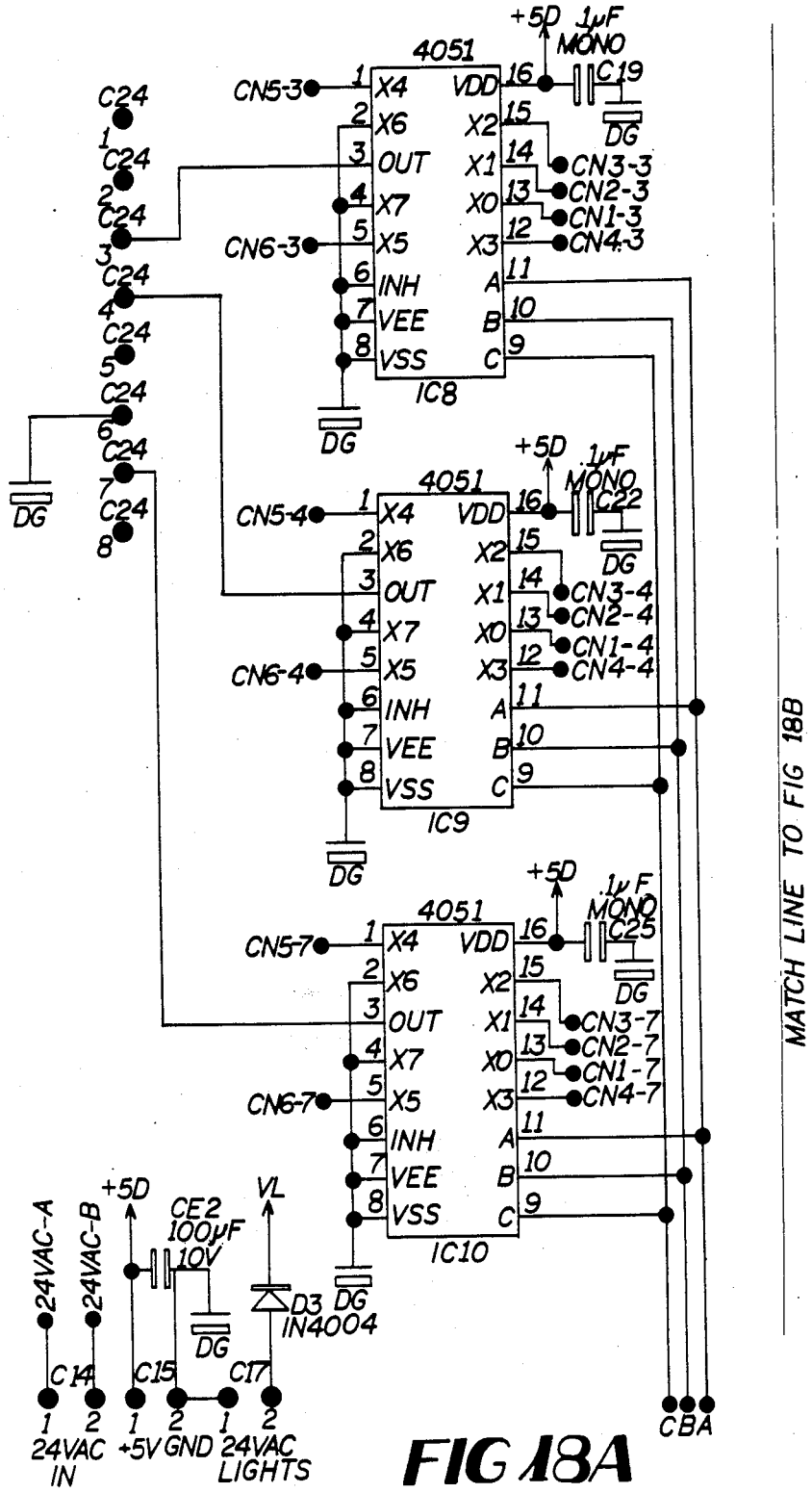
Figure 18B:
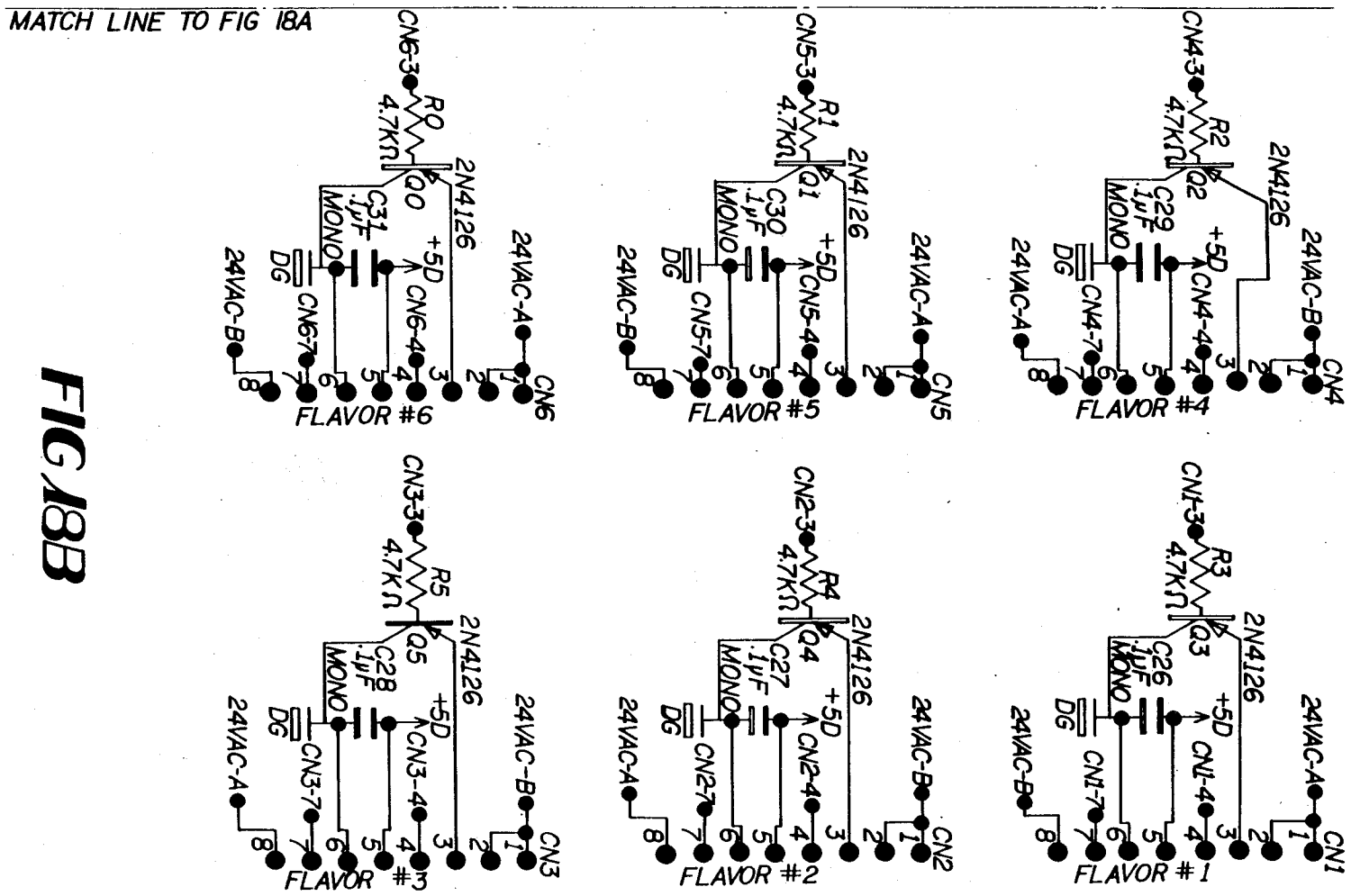
Figure 19A:
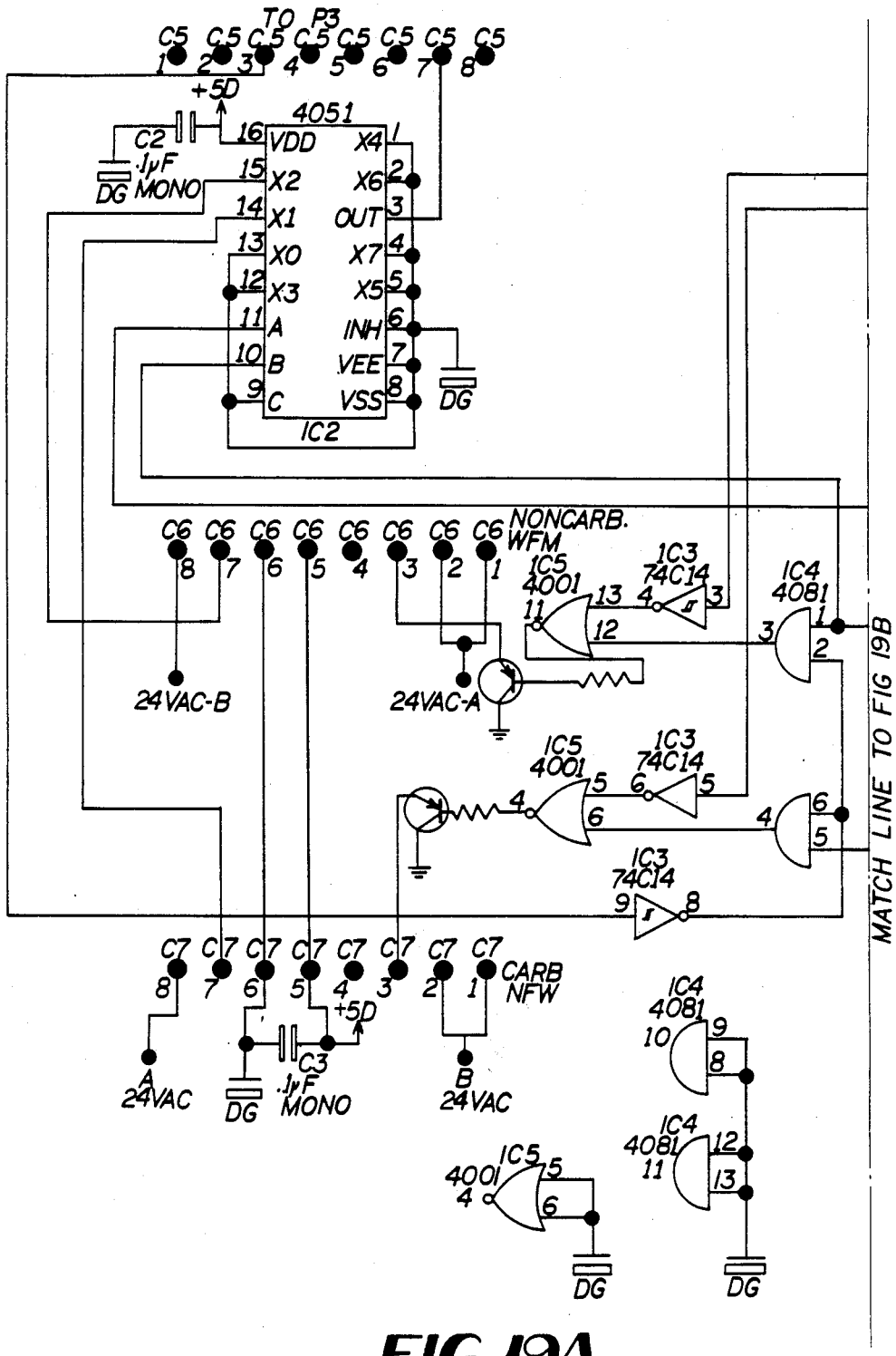
Figure 19B:
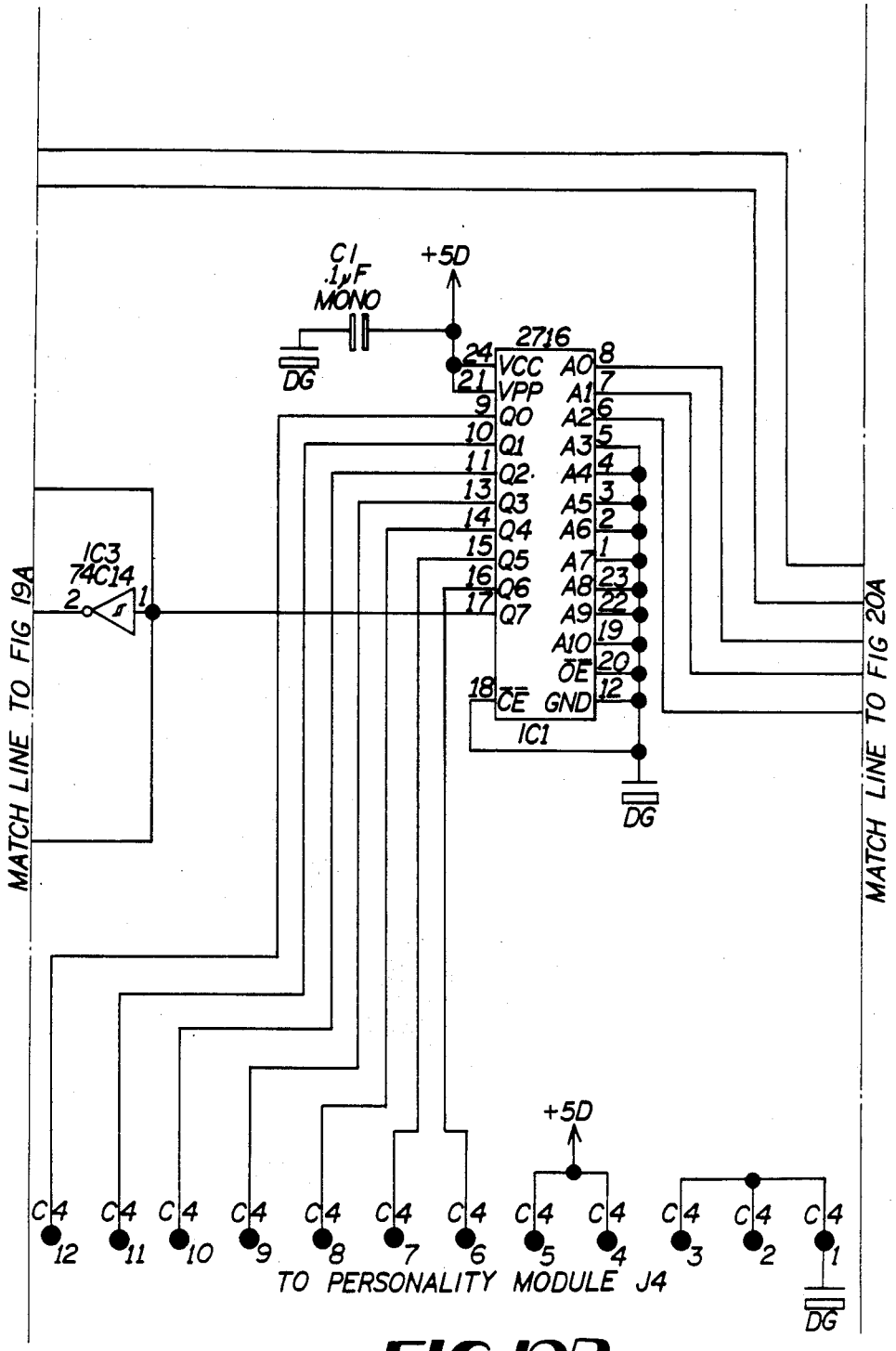
Figure 20A:
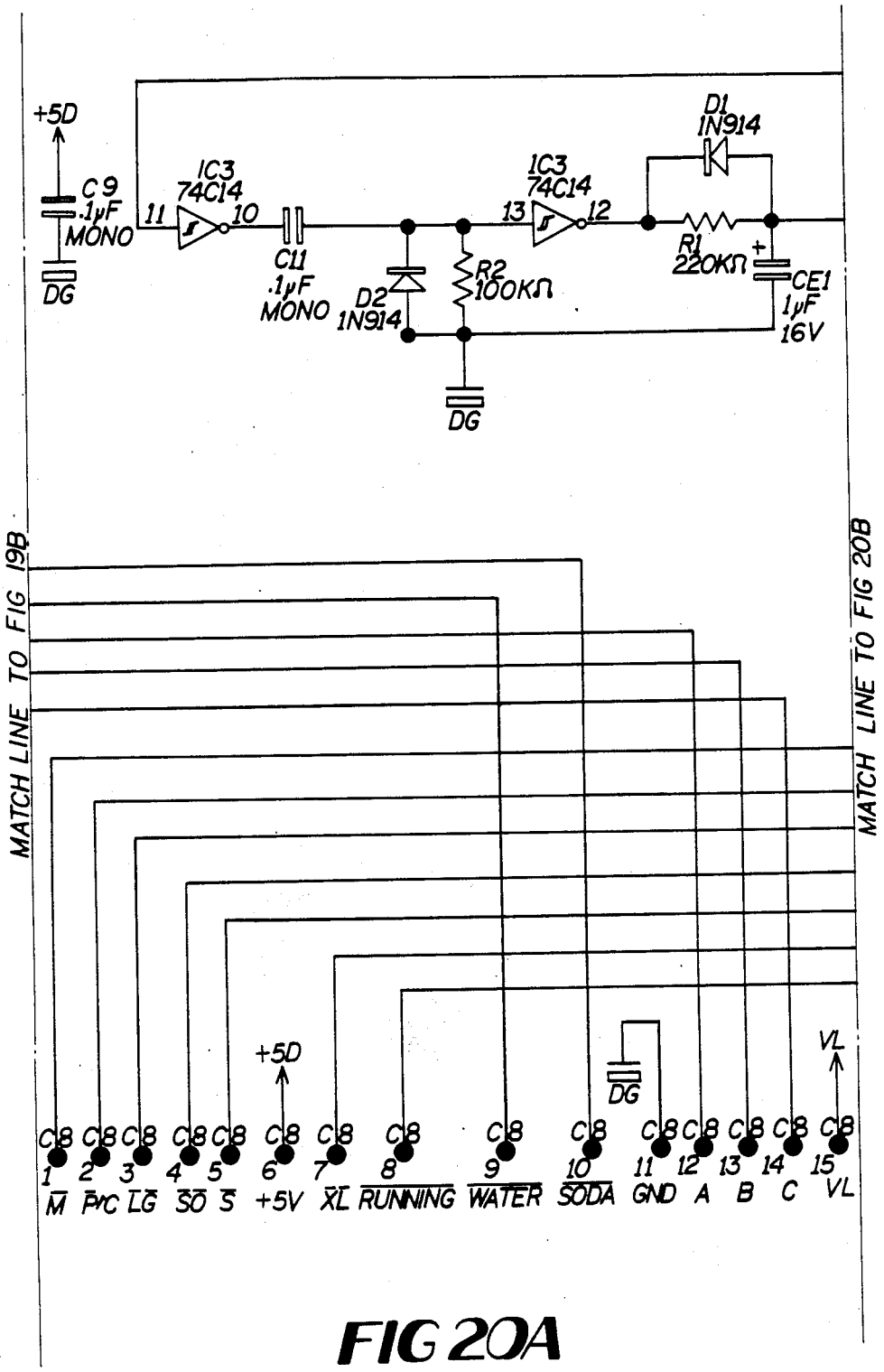
Figure 20B:
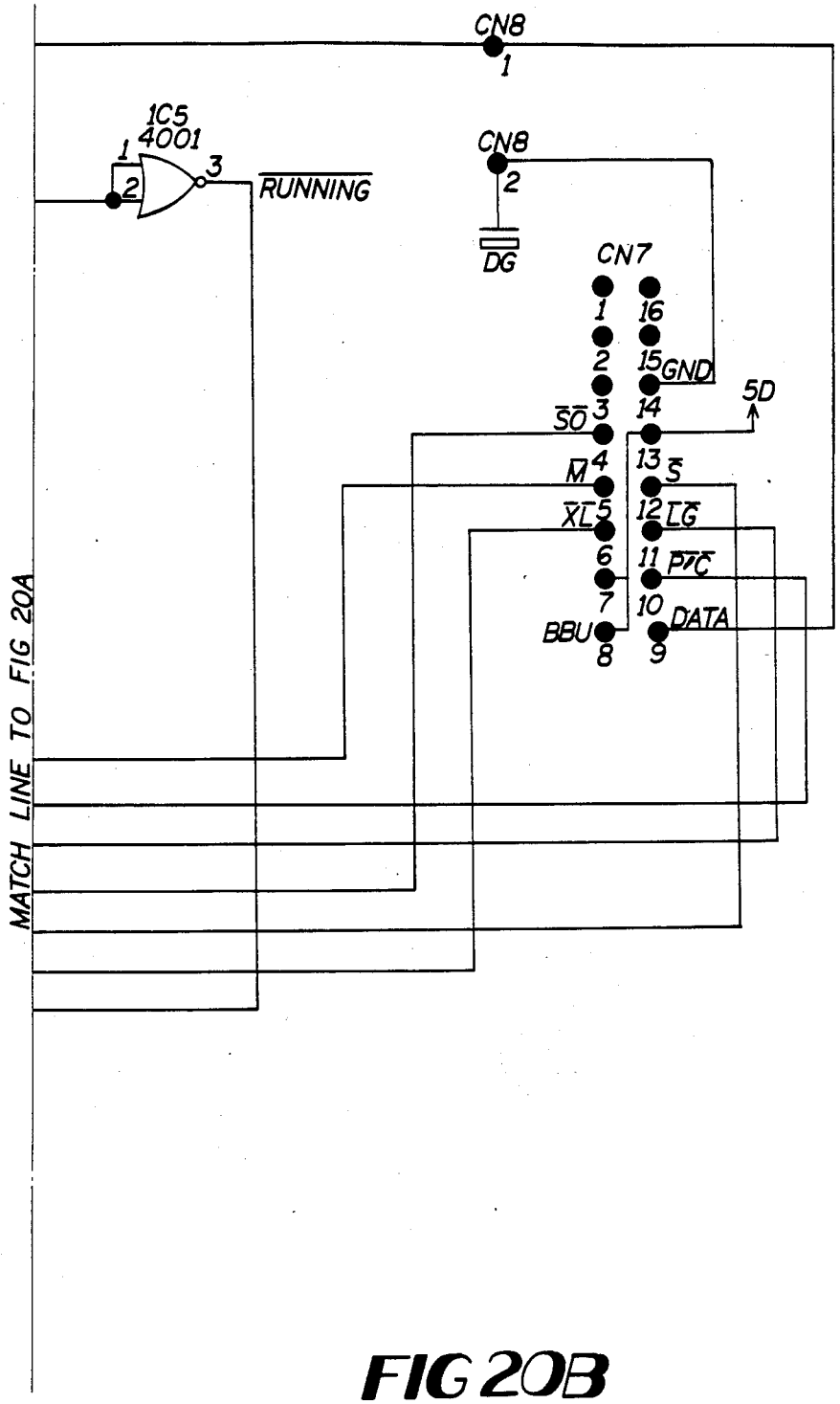

FIG. 7 is a block diagram showing the overall program scheme of this invention, which is described in detail below with reference to FIGS. 8–20.

With reference now to FIGS. 8–15, the interface board microprocessor monitors the push buttons 20 and controls all of the functions of the interface board. The flow chart (FIGS. 8–15) shows the program flow, and the following is a description of how the program operates.

RESET/INITIALIZE ROUTINE

This selection of the program sets up the input and output ports and clears the registers that will be used later in the program.

PUSH BUTTON MONITOR ROUTINE

Normal Operation

When a flavor button is pushed, all flavor button lights are turned off except for the flavor selected. When a size button is pushed, all size lights are also turned off except for the size selected. Once a flavor and a size have been selected, control is transferred to the "Normal Pour Routine".

Sold Out Condition

When a particular flavor is out of syrup, as determined in the "Post Pour Routine", the light for that flavor is turned off.

If a button is pushed for a flavor that is sold out, control is transferred to the "Sold Out Routine".

Pour Cancel Operation

Nothing will happen if the Pour/Cancel button is pushed without a flavor button having been selected. If a flavor has been selected and the Pour/Cancel button is pushed, program control is transfered to the "Pour Cancel Pour Routine."

SODAR Operation

If a SODAR (automatic ultrasonic filling system) unit is connected to the TECH TOWER, the size lights are turned off as soon as SODAR senses a cup and control is transferred to the "SODAR Pour Routine."

SOLD OUT ROUTINE

If a flavor is sold out, this routine provides a way of restoring syrup to the valve. Upon entering this routine, the SOLD OUT light is turned on indicating to the user that the flavor selected is sold out. Next, the syrup and water flow meters needed to dispense this product are selected and the proper personality module data is selected. All size lights except for the Pour/Cancel light are turned off showing the user that they can only use the Pour/Cancel button to purge the syrup tube and bring new syrup to the valve.

When the Pour/Cancel button is pressed, the valve is turned on. When the Pour/Cancel button is released, the program checks the "Sold Out" signal from the Control board. If this signal indicates the product is no longer sold out, the flag in the Tower interface memory showing that flavor as being sold out is cleared, and the program returns to the "Push Button Monitor" routine. If the signal shows that the flavor is still sold out, the program returns to the "Push Button Monitor" routine with the sold out flag unchanged.

SODAR POUR ROUTINE

This routine will be called if SODAR sensed the presence of a cup in the "Push Button Monitor" routine.

Normal

This routine will wait, as long as SODAR is sensing a cup, for the user to select a flavor. Once the flavor is selected, the Tower interface board will select the proper water flow module, syrup flow module, and personality data, and will activate the valve until SODAR indicates the valve should turn off. Once the valve is off, the Tower interface board will wait up to four seconds for SODAR to indicate the valve should turn on again for a top off. After the top off period control is transferred to the "Post Pour Routine."

Sold Out

If a sold out flavor is selected in the "SODAR Pour Routine," the program turns on the sold out light to show the user that the selected flavor is sold out and waits for the user to make another choice.

NORMAL POUR ROUTINE

This routine is called when a flavor and a size have been selected in the "Push Button Monitor" routine. This routine will cause the Tower interface board to select the proper water flow module, syrup flow module, and personality data for the flavor selected. It will signal the Control board to dispense the selected size. While the drink is pouring, the routine monitors the Pour/ Cancel button. If the user pushes the Pour/Cancel button, the Tower interface board signals the Control board to stop pouring. During the pour, the Tower interface board monitors the data line from the Control board. As long as the Control board is pouring a drink, the data line is at a constant 5 volts. The Tower interface board determines the drink is finished when the data line from the Control board begins transmitting data. When the drink is finished or cancelled, control is transferred to the "Post Pour Routine."

POUR CANCEL POUR ROUTINE

This routine is called when a flavor has been selected and the Pour/Cancel button is pushed in the "Push Button Monitor" routine. This routine causes the Tower interface board to select the proper water flow module, syrup flow module, and personality data for the flavor selected. As long as the Pour/Cancel button is pushed, the Tower Interface board will send a signal to the Control board to pour. When the Pour/Cancel button is released, the program will wait 3 seconds for the drink to be topped off. Three seconds after the last top off, control is transferred to the "Post Pour Routine."

POST POUR ROUTINE

This routine is called at the conclusion of a drink pour by the "SODAR Pour Routine," "Normal Pour Routine" and "Pour Cancel Pour Routine. This routine checks the sold out signal from the Control board to determine if the selected flavor ran out of syrup during the last pour. If the Control board indicates that the syrup ran out during the previous pour, the Tower interface Control board sets a flag in its memory to show that flavor is sold out.

This routine turns all of the size lights on and it turns on the flavor lights for each flavor that is not sold out. When this routine is finished, control is returned to the "Push Button Monitor"routine.

The electrical circuits shown in FIGS. 16–20 will now be described. The flavor and portion size push buttons are scanned by a 74C922 integrated circuit. The keyboard scanner delivers a four bit parallel signal to the microprocessor representing the key that is being pressed. A data available strobe from the keyboard scanner is inverted and provided to the interrupt request pin of the microprocessor. The water and the soda buttons on the key board provide a direct signal to turn on the water and soda flow meters, respectively.

The microprocessor is a Motorola 68701. Twenty lines of the microprocessor are used as outputs. Twelve of the output lines are connected to a darlington transistor driver which drives incandescent lamps in the flavor and size push buttons and a sold out indicator lamp. Five of the outputs are connected to inverters. The inverted signals are connected to the Control board size selection inputs. The remaining three outputs from the microprocessor are used as address lines which select the proper syrup flow meter, water flow meter and personality module data for the flavor selected. The three address lines are connected to four 4051 analog switches. The analog switches connect the proper water and syrup flow meter to the Control board depending upon what flavor has been selected. IC2 switches the water flow meter signals. IC 8, 9, and 10 switch the syrup flow meter signals. The three address lines are also connected to IC 1, a 2716 EPROM. The EPROM contains the data that would normally be provided to the Control board through the personality module. This data is different for each of the six flavors. The data selects the mixture ratio, the syrup viscosity, and whether carbonated water or non-carbonated water will be dispensed with the syrup.

The microprocessor monitors a signal from a SODAR unit if connected. It also monitors a signal from the Control board which goes low if the syrup ran out during the past pour.

IC 4 and 5 are gates which switch a signal from the Control board to the water flow meters depending upon whether carbonated or non-carbonated water is to be used with the flavor selected.

The microprocessor also monitors the data signal from the Control board. The signal on the Smart Valve Control board data line is used to determine if the Control board is currently trying to dispense a drink. When the Control board is in the process of dispensing a drink, the data line stays at a constant 5 volts. IC 3, IC 5 and the associated components are used to monitor the data line. If the data line stays high for more than 0.25 sec. the running signal goes dlow. When the pour is finished, data is again transmitted over the data line and the running signal goes high.

While the preferred embodiments of this invention have been described above in detail, it is to be understood that variations and modifications can be made therein without departing from the spirit and scope of the present invention. For example, other numbers (than six) of syrup lines can be used, and other numbers (than two) of water lines can be used. Further, the valve assembly can be used in other equipment than towers, and more than one can be used. The circuit board and the panel 18 need not be in the tower head, but can be remote therefrom. An automatic ultrasonic filling system can be used in place of the portion size buttons, such a system is described in U.S. Pat. No. 4,559,979.

We claim that:

1. A multiflavor beverage dispensing valve assembly comprising:

(a) a valve assembly including a flow block having a water conduit and a plurality of syrup conduits therethrough;

(b) said valve assembly having a single nozzle assembly for dispensing any one of a plurality of different beverages therefrom;

(c) said flow block including a flow meter and a flow control means in each of said conduits and wherein each of said flow meter and said flow control means for a particular conduit are combined in a single flow control module;

(d) each of said conduits having a distal end at said nozzle assembly;

(e) said valve assembly including a selection panel having a plurality of beverage selection buttons thereon including one button for each of said syrup conduits; and (f) said valve assembly including control means for controlling the dispensing of beverages from said valve assembly and for controlling the syrup to water ratio for beverages to be dispensed, said control means being connected to each of said flow meters, each of said flow control means and each of said buttons, said control means including a control board having a microprocessor for controlling the syrup to water ratio, and including only a single interface board having a microprocessor for monitoring all of said selection buttons and for connecting the correct flow meter and flow control means to said control board, said control means also including memory means containing data on a plurality of syrups corresponding to said plurality of syrup conduits including mixture ratio, syrup viscosity and whether carbonated or non-carbonated water is to be used.

* * * * *